United States Patent [19]

Deveney, Jr.

[11] 4,301,563

[45] Nov. 24, 1981

[54] METHOD FOR ROLL POINTING A THREADED SCREW

[75] Inventor: Charles H. Deveney, Jr., Lower Burrell, Pa.

[73] Assignee: Aluminum Company of America, Pittsburgh, Pa.

[21] Appl. No.: 123,305

[22] Filed: Feb. 21, 1980

[51] Int. Cl.[3] ..... B21H 3/02

[52] U.S. Cl. ..... 10/10 R; 10/4; 10/9

[58] Field of Search ..... 10/2, 4, 9, 10 R, 20.5, 10/21, 27 R; 29/414, 415, 403.1; 411/411, 424, 395, 416; 408/29, 30

[56] References Cited

U.S. PATENT DOCUMENTS

| | | | |
|---|---|---|---|
| 1,232,876 | 7/1917 | Wilcox | 10/4 X |
| 2,162,891 | 6/1939 | Johnson . | |
| 2,314,391 | 3/1943 | De Vellier . | |
| 2,636,194 | 4/1953 | Schneider | 10/10 R |
| 2,652,577 | 9/1953 | Chiaberta | 10/2 |
| 3,196,654 | 7/1965 | Gordon . | |
| 3,517,542 | 6/1970 | Skiecski | 10/4 |
| 3,728,750 | 4/1973 | Stillman et al. | 10/10 R |
| 4,149,287 | 4/1979 | Skiecski | 10/9 |

*Primary Examiner*—Howard N. Goldberg
*Attorney, Agent, or Firm*—Max L. Williamson

[57] ABSTRACT

A method for making a pointed, threaded fastener by threading, tapering and pointing in thread rolling equipment a screw blank having a cavity extending longitudinally into the blank from the end of the shank.

8 Claims, 14 Drawing Figures

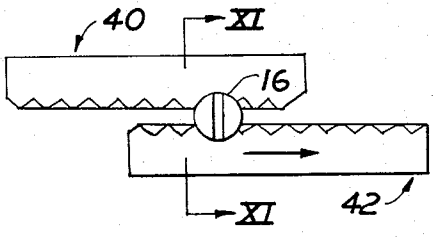
FIG. 6
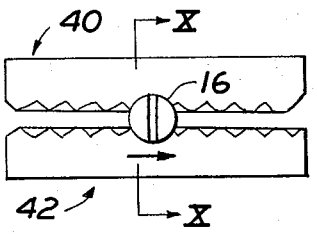
FIG. 7
FIG. 8
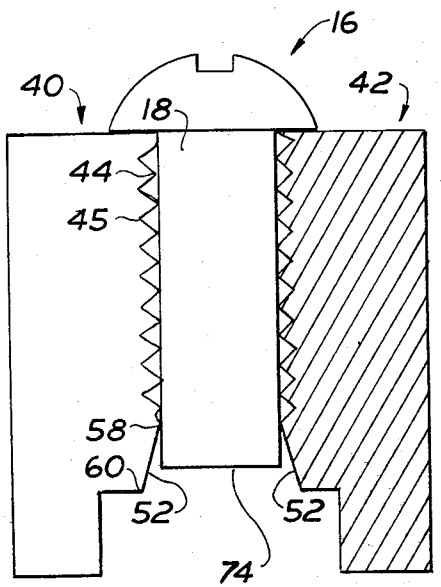
FIG. 9
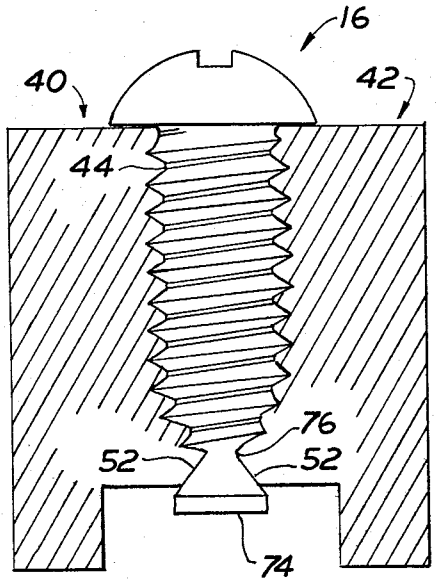
FIG. 10
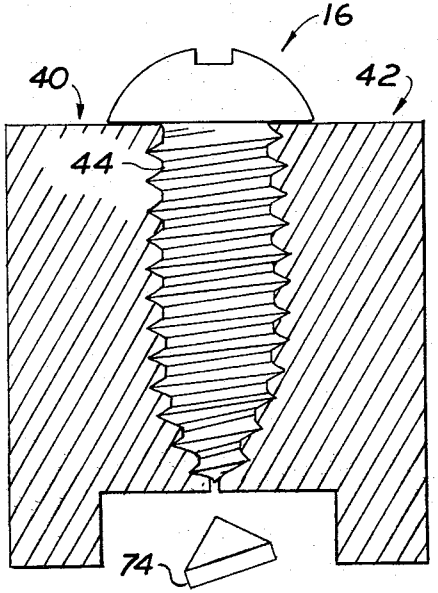
FIG. 11

METHOD FOR ROLL POINTING A THREADED SCREW

BACKGROUND OF THE INVENTION

This invention relates to a method for making a roll-threaded, pointed screw and more particularly, a method using a blank having a hollow end as the workpiece from which such a screw is formed.

A variety of methods are known for producing pointed threaded fasteners, such as wood screws or sheet metal screws. Some of the most widely used methods include forming the threads by progressive movement of a blank through thread-forming dies as described in Gordon, U.S. Pat. No. 3,196,654; Johnson, U.S. Pat. No. 2,162,891; and DeVellier, U.S. Pat. No. 2,314,391.

One method of making a roll-threaded pointed fastener utilizes a blank having a conical point and then rolling the threads thereon, but this method has disadvantages which may include removal of metal to form the conical end and there may also be difficulty in providing sufficient metal in the conical end to form a thread continuously to the tip. Johnson, U.S. Pat. No. 2,162,891, overcomes the problem of metal removal by die forming a generally tapered end during a cold-heading step. Johnson successively forms decreasing diameter cylinders on the end of the blank and thus provides a stepped, tapered screw blank without removing metal.

DeVellier, U.S. Pat. No. 2,314,391, describes a method that is particularly adapted for roll-forming a double threaded pointed fastener. DeVellier utilizes a blank having a generally tapering point with excess metal provided in the generally tapering point portion so that there is sufficient stock to continuously form threads to the point of the fastener.

Gordon, U.S. Pat. No. 3,196,654, eliminates the use of a pointed or tapered blank. A uniform diameter stock is cold-headed in a conventional manner and the headed blank progresses through a thread-forming die of the patentee's invention. The die is so constructed that as the blank progresses through the die, an end portion of the blank is coincidentally threaded and tapered. The excess metal from the blank is extruded outwardly from the tapered portion as the tapering continues until the tip of the screw is formed at which point a configuration within the die causes the excess extruded metal to break off. Although this method eliminates a separate tapering step, it is difficult to use in producing a consistently good point on fasteners made of certain metals. Since the tapering of the end is done mechanically in a die, the metal is significantly cold worked in the tapered portion and this can cause excessive embrittlement of some metals in the zone of the prospective point of the fastener and thus produce a jagged or irregular point when the excess metal is broken away as just described.

Many of the tempered aluminum alloys commonly used for making threaded pointed fasteners, for example, are susceptible to embrittlement when subject to the degree of cold work required to produce such a fastener by threading and pointing a uniform diameter screw blank. Therefore, to insure producing a consistently good point on threaded pointed fasteners made from many of the commonly used aluminum alloys, it has been necessary to either machine the threads and point which is slower than thread rolling and generates excess scrap, or to pretaper the blank before thread rolling. In either case, the cost of the finished fastener is greater than a fastener produced from processing a blank having a uniform diameter shank through thread rolling and pointing equipment.

It is desirable, therefore, to provide an improved method for producing a pointed threaded fastener having a consistently good point by thread rolling and tapering a uniform diameter blank through a die.

SUMMARY OF THE INVENTION

A method is provided for producing a pointed threaded fastener having a consistently good pointed end from a screw blank having a uniform diameter and a hollow cavity extending axially inwardly from one end thereof by coincidentally rolling threads and tapering the blank in a thread rolling die set. As the blank progresses through the die set, it is continuously thread rolled and tapered inwardly in a lower portion of the blank adjacent the closed end of the inwardly extending cavity. The action of the die set in forming threads and tapering the blank causes a portion of the metal to be displaced and this displaced portion is extruded away from the inwardly tapering portion towards the end portion of the blank having the cavity contained therein. A portion of the extruded metal is forced into the cavity and another portion comprising a connecting neck between the tapering portion and the end portion is progressively reduced in diameter. When the blank has progressed through the die set to reduce the neck portion to a minimal diameter, an element of the die set acting against the end portion having the cavity contained therein causes it to break away from the semi-finished blank which progresses through a final sizing and finishing of the threads before exiting from the die set as a finished fastener.

It is an object of this invention to provide a method of producing a threaded pointed fastener from a uniform diameter blank by coincidentally forming threads and tapering to a point by using a thread rolling die.

This and other objects of this invention will be more fully appreciated by reference to the following description and attached drawings.

BRIEF DESCRIPTION OF THE DRAWINGS

FIG. 6 is a top view of a die set and a screw blank contained between the spaced apart working faces of the die members at the beginning of the roll threading cycle in making a screw by a process of this invention.

FIG. 7 is a top view of the die set and screw blank shown in FIG. 6 after the screw blank has progressed approximately half way through the roll threading cycle.

FIG. 8 is a top view of the die set and screw blank shown in FIGS. 6 and 7 after the screw blank has progressed through the roll threading cycle to the point that a lower end portion of the blank has been broken away from the partially finished screw.

FIG. 9 is an end view, taken along lines IX—IX of FIG. 6, of the stationary die member and a cross-sectional view of the reciprocating die member in a thread rolling die set in a spaced apart, matched relationship with each other and having a fastener blank contained between the working faces of the die members at the beginning of the thread rolling cycle with die members longitudinally disposed in relationship to each other, as shown in FIG. 6.

FIG. 10 is a cross-sectional view, taken along line X—X of FIG. 7, of the die members and a plan view of a partially processed screw blank held therebetween when the die members are in a longitudinal relationship with each other, as shown in FIG. 7.

FIG. 11 is a cross-sectional view, taken along line XI—XI of FIG. 8, of the die members and a plan view of a semi-finished screw held therebetween when the die members are disposed in a longitudinal relationship with each other, as shown in FIG. 8, and further shows a plan view of a lower end portion of the screw blank which has been separated from the semi-finished screw.

DESCRIPTION OF THE PREFERRED EMBODIMENTS

Figure 1:
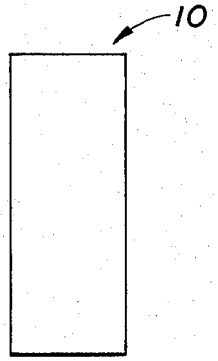
FIG. 1 is an elevation view of a wire or rod stock for making a fastener blank used in a method of this invention.
Figure 2:
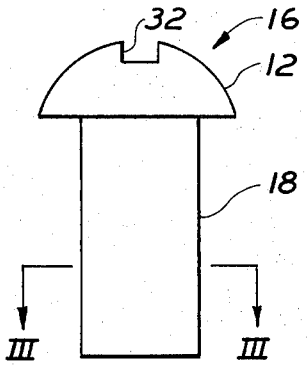
FIG. 2 is an elevation view of a fastener blank produced from the stock shown in FIG. 1 by a cold-heading process.
Figure 3:
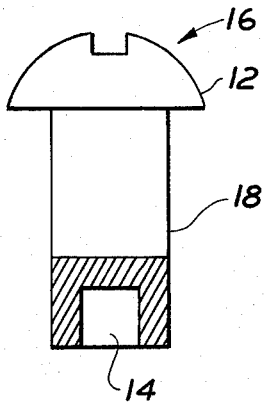
FIG. 3 is an elevation view of the blank shown in FIG. 2 with a sectional view, taken along lines III—III of FIG. 2, of an end portion.

In producing a threaded pointed screw by a process of this invention, a conventional cylindrical wire or rod stock 10, as shown in elevation in FIG. 1, is introduced into a cold-heading machine to produce a screw blank 16, as shown in FIGS. 2 and 3. The screw blank 16 formed from the stock 10 has a head portion 12 and a shank portion 18 extending outward from the head portion 12 with the head portion 12 and shank portion 18 having coincident axes. The head portion 12 is shown as a slotted round head for convenience, but it is apparent that the head portion 12 could be a pan head, hex head or any other head configuration that may be produced by well-known conventional cold-heading methods. A cylindrical cavity 14 extending axially inwardly from the end of the shank 18 is provided for a purpose to be explained later.

The cylindrical cavity 14 is preferably produced by an extrusion process during the cold-heading operation, but it is apparent that the cavity could be produced as a separate step and that the cavity 14 could alternately be made by drilling. For the purposes of this invention, cavity 14 has a length approximately equal to the difference between the length of the shank 18 of the blank 16 and the length of the shank of the finished screw made from the blank, and a diameter approximately equal to between 0.6 and 0.4 of the diameter of shank 18 with a preferred diameter of 0.5 of the diameter of shank 18.

Figure 4:
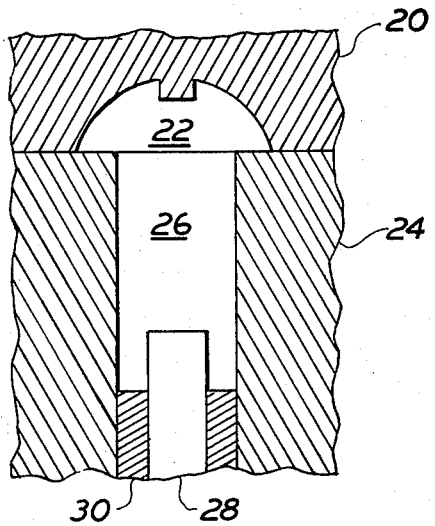
FIG. 4 is a partial cross-sectional view of the tools used to produce the blank shown in FIG. 2.

The preferred method of forming the cavity 14 is shown in FIG. 4 in a partial section drawing of cold-heading tools. An upper die block 20 includes a cavity 22 of the desired head configuration. In this drawing, a round head cavity 22 is shown and cavities 22 and 26 are in coaxial alignment. A lower die block 24 has a cylindrical cavity 26 and in this drawing lower die block 24 is shown in a closed portion with upper die block 20 abutting and bearing against lower die block 24. For clarity of illustration a cylindrical reciprocating mandrel 28 is shown in elevation in its most inward position extending inward into cavity 26, through knockout punch 30. For the purposes of this invention, mandrel 28 has a diameter equal to the desired diameter of cavity 14. Knockout punch 30 is a cylindrical reciprocating tool having a central bore within for containment of reciprocating mandrel 28. The mandrel 28, punch 30 and cavity 26 are in coaxial alignment.

To form the screw blank 16, die blocks 20 and 24 are positioned in a spaced-apart relationship to permit insertion of wire stock 10 into die cavity 26. At the beginning of the forming cycle with the die blocks 20, 24 in a spaced apart relationship, the mandrel 23 and punch 30 are in a position in relation to cavity 26, as shown in FIG. 4. That is, punch 30 is disposed so that its end surface is located away from the upper end of cavity 26 a distance equal to the desired length of screw blank shank 18 and mandrel 28 is extended beyond the face of punch 30 a distance equal to the desired depth of cavity 14.

With the elements of the forming tools in the relationship just described, stock 10 is inserted into cavity 26. The stock 10 has a diameter approximately equal to cavity 26 to allow insertion of stock 10 into cavity 26 and a length necessary to provide the volume of metal necessary to form the blank 16.

Die blocks 22 and 24 then progressively come together, simultaneously extruding the stock 16 around the mandrel 24 to form the cavity 14 and forming head 12 by forcing metal to ultimately fill cavity 22 when the blocks 20, 24 are abutting one another, as shown in FIG. 4.

After forming the blank 16, as just described, the die blocks 20 and 24 are again positioned in a spaced apart relationship, the mandrel 28 is withdrawn from the cavity 14 and the punch 30 is actuated to move upward in the cavity 26 and thus push and eject the blank 16 from the cavity 26.

Although the forming operation has been described so as to include the slot 32 in the head 12, it is apparent that the head 12 could be formed without a slot 32 and the slot 32 then machined in a separate operation.

With the blank 16 formed as just described, the blank is processed through thread rolling and tapering dies, as described, for example, in Gordon U.S. Pat. No. 3,196,544. However, it is not intended that a process of this invention is limited to that described in U.S. Pat. No. 3,196,654. A process of this invention is adaptable to any well-known method of coincidentally roll-forming and tapering a threaded pointed fastener utilizing a fastener blank having a uniform shank diameter.

Referring now to FIGS. 5, 6, 7, 8, 9, 10 and 11, the die set for roll threading, tapering and pointing a spaced apart threaded screw by a method of this invention is comprised of two die members 40 and 42. The die members are adapted to be mounted in a thread rolling machine for relative reciprocal motion to form a screw blank mounted therebetween, as will be explained later.

Die member 40 comprises a generally rectangular block formed from a suitable tool steel. It is provided with a plurality of tapered ridges 44 projecting outward from the working face 45 and extending diagonally downward from an edge 46 of the top face of die member 40. As may best be seen by referring to FIGS. 9, 10 and 11, the ridges 44 diverge from a sharply defined point to a generally flat surface from the entry end 48 to the exit end 50 of die member 40.

An inclined extrusion surface 52 having a plurality of serrations 54 thereon extends longitudinally inward to a point 56 approximately near the midpoint of the length of die member 40. A cutting edge 58 is the upper margin of the inclined surface 52 and extends generally diagonally downward from the entry end 48 of die member 40 through point 56 to a point 59 approximately three-fourths of the length from the entry end 48 of die member 40. A lower margin 60 along the working face 45 of die member 40 extends diagonally from point 56 to the entry face 48 of die member 40. Thus, the extrusion surface 52 has a triangular shape defined by the cutting edge 58, the lower margin 60 and an entry end edge 62.

A generally vertical planar surface 64 extends longitudinally from point 56 to the exit end of die member 40. The generally vertical surface 64 is defined by an upper margin 66 at the lower termination of downwardly extending ribs 44 extending longitudinally from point 56 to the exit end of die member 40, a vertical edge 68 of the exit end face of die member 40, a bottom margin 70, parallel to upper margin 66, extending longitudinally inward to point 59 from the exit end face of die member 40 and a diagonal margin connecting points 59 and 56.

A relieved portion 72 is provided near the exit end of die member 40 to permit free roll-off of the finished screw after processing through the die set, as will be explained later.

Die member 42 is in a matched relationship with die member 40 and is identical with die member 40 except that it typically would not have the relieved portion 72 near the exit end.

To roll form the threads, taper and point a screw by a process of this invention, die member 40 is attached to a conventional thread-rolling machine so as to be stationary. Die member 42 is attached to the thread-rolling machine in a matched relationship with die member 40, as shown in FIGS. 9, 10 and 11, and that portion of the machine having die member 42 attached thereto is adapted to permit a reciprocal motion of die member 42 relative to die member 40.

Thus, at the beginning of the cycle, die members 40 and 42 are disposed as shown in FIG. 6 with their working faces on opposing ends in a spaced apart relationship with one another and a screw blank 16 contained therebetween. The arrow in FIGS. 6, 7 and 8 on die member 42 is provided to show its direction of motion relative to die member 40. FIG. 9 shows an end view of die member 40, a cross-sectional view through die member 42 and a plan view of screw blank 16 when disposed as shown in FIG. 6. A lower portion 74 of screw blank 16 extends below the threadforming ribs 44 of die members 40 and 42 so that a portion thereof, typically at least 1/32 inch, is disposed between the opposing extrusion surfaces 52 of die members 40 and 42.

Lower portion 74 is provided to keep the screw blank 16 vertically aligned as it progresses through the die set, as will be explained later. Reciprocal motion of die member 42 causes the screw blank 16 to rotate about its longitudinal axis and move between the working faces 45 of die members 40 and 42 in a direction parallel to the movement of die member 42. As may best be seen by referring to FIGS. 10 and 11 showing a screw blank 16 at intermediate points in its progress through the thread-forming cycle, the ribbed working faces 45 of die members 40 and 42 cooperate with each other to force portions of the metal in the screw shank 18 to fill the spaces between adjacent ribs on the die members 40 and 42 and thus form threads on the shank 18. In addition, a portion of the shank 18 is progressively tapered causing metal to be extruded downwardly between the extrusion surfaces 52. The serrations 54 provided on extrusion surfaces 52 function to grip the lower portion 74 of the shank 18 as the blank 16 progresses through the die set so as to maintain the blank 16 in a vertical alignment in relation to the die set and prevent a premature break-off of the lower portion 74. It may be seen by comparing FIGS. 9 and 10 that extrusion surfaces 52 of die members 40 and 42 converge towards each other in their spaced apart relationship as die member 42 reciprocally moves which causes a change in shape of the lower portion 74 of screw blank 16.

FIG. 7 shows the relationship of die member 40 and 42 midway through the thread-rolling cycle with a semiprocessed blank 16 held therebetween. As may be seen in FIG. 10, the blank 16 has been substantially tapered at this stage and the lower portion 74 of the blank 16 is being extruded downwardly as a portion is formed into a conical shape between the extrusion surfaces 52 of die members 40 and 42.

Further progression of the blank 16 through the threading process causes a continuous reduction in diameter of a connecting portion 76 between the threaded portion of the screw blank 16 and the lower portion 74 until the lower portion 74 is broken away as shown in FIG. 11, with die members 40 and 42 in a relationship with one another, as shown in FIG. 8.

Figure 5:
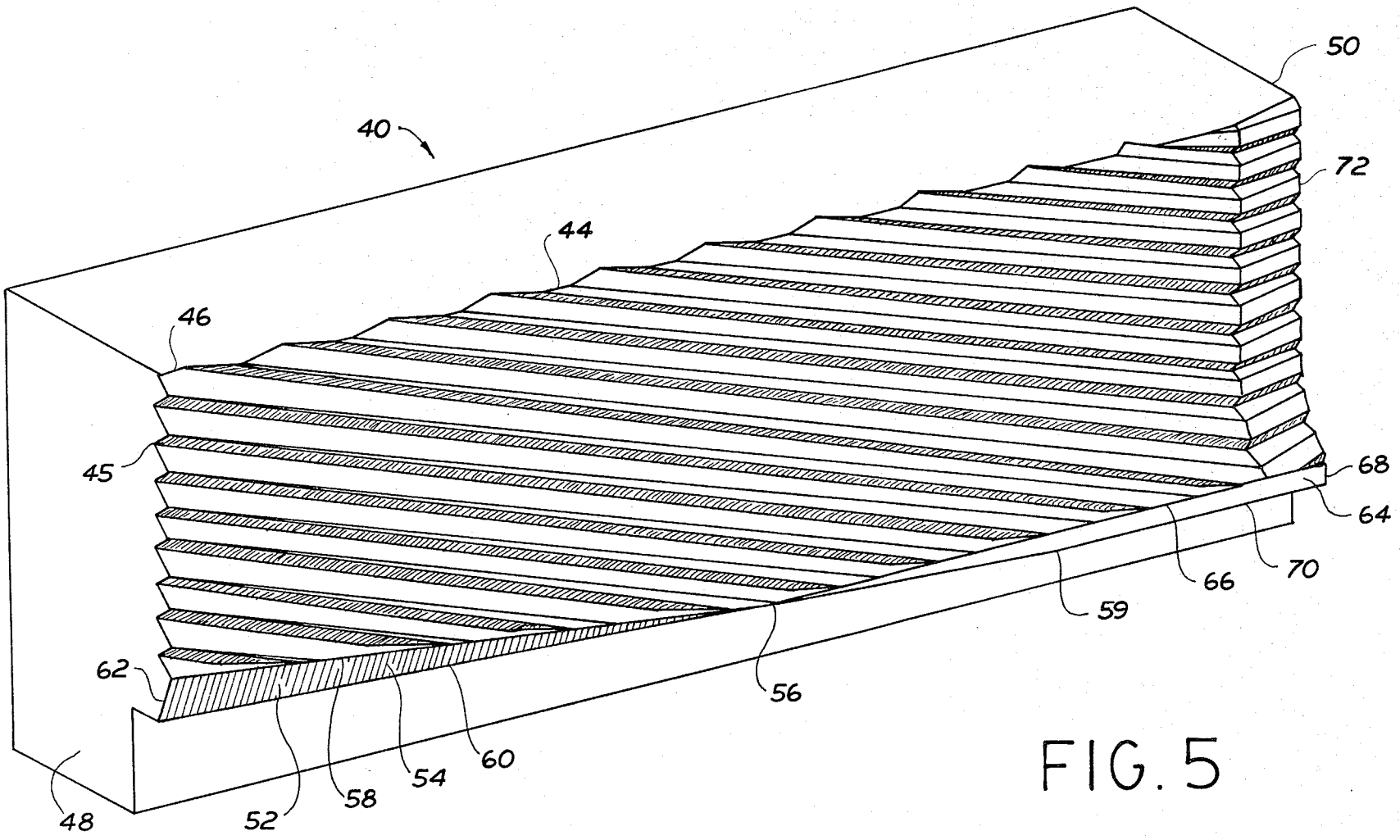
FIG. 5 is an isometric drawing of a stationary die member of a die set that may be used in conventional roll threading equipment to form, thread, taper and point a screw by a method of this invention.

The cutting edges 58 of the die members 40, 42 slope diagonally downward between points 56 and 59, as shown in FIG. 5, and it is the action of the edges 58 against the lower portion 74 which causes it to break away from the blank 16, as may be seen in FIG. 11.

As die member 42 and screw blank 16 move through the cycle beyond the position shown in FIG. 8, the ribs 44 on die members 40 and 42 function to provide the final sizing and finishing of the threads on the finished screw before it exits at the relieved portion 72 of die member 40.

It can be appreciated that as the screw is formed in a manner just described, a substantial amount of cold work is induced into the metal adjacent the finished point of the screw. As has previously been explained, some metals become excessively embrittled due to this cold work and this embrittlement can cause a premature break off of lower portion 74 before the blank 16 progresses to the desired position shown in FIG. 8.

By providing a cavity extending longitudinally inwardly from the bottom face of the blank 16 in accordance with this invention, the periphery of the blank 16 in contact with the working face of die members 40, 42 is permitted to deform without affecting inward portions of the blank, and at least a portion of the metal being extruded and worked in the area of the point is forced into the cavity, thus decreasing the amount of cold work induced in the metal and the consequent embrittlement.

Figure 12:
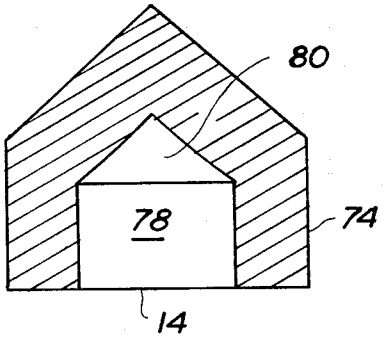
FIG. 12 is a cross-sectional view of the separated end portion of the blank shown in FIG. 11.

FIG. 12 is a cross-sectional view of the lower portion 74 of screw blank 16 after it has broken away in the process previously described. It may be seen that the cavity 14, as shown in FIG. 3, has been transformed from a cylindrical shape into a shape having a generally cylindrical lower portion 78 and a generally conical upper portion 80.

Figure 14:
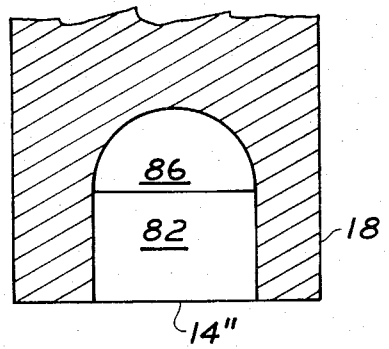
FIG. 14 is a cross-sectional view of a further alternate shaped cavity to that shown in FIG. 13.
Figure 13:
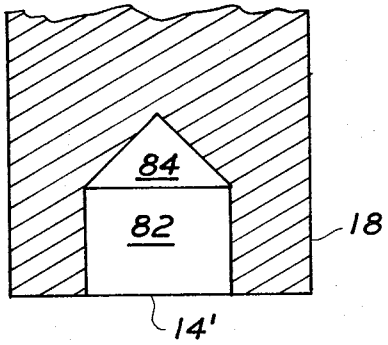
FIG. 13 is a cross-sectional view of an alternate shaped cavity extending longitudinally inwardly from an end of a screw blank that can be used in a process of this invention for making a pointed screw.

It is apparent that other embodiments of the screw blank having cavities such as those shown in section in FIGS. 13 and 14 could be utilized without departing from the spirit of this invention. FIG. 13 shows a sectional view of an end portion of a shank 18 of a blank 16. The cavity 14' is comprised of a cylindrical first portion 82 and a conical second portion 84 extending inwardly from the end of shank 18 with their axes coincidental with the axis of shank 18. The first portion 82 extends inwardly from the end of shank 18 and the conical portion 84 extends inwardly from the inner end of first portion 82.

The further alternate embodiment of a cavity 14'' shown in FIG. 14 comprises a cylindrical first portion 82 and a hemispherical second portion 86 extending inwardly into the end of shank 18 with their axes coincidental with the axis of the shank 18. The first portion 82 extends inwardly from the end of shank 18 and the second portion 86 extends inwardly from the first portion 82.

For the purposes of this invention, regardless of the shape of the cavity, the length or extent of the cavity into the screw blank should be limited to that length which will insure that the entire cavity after being transformed in shape, as previously described in practicing this invention, is included within the separated end portion of the blank. It can be appreciated that as the blank progresses through the threading, tapering and pointing cycle that the disposition of the cavity relative to the head end of the blank changes. Metal in the shank that is displaced during the aforementioned cycle is continuously being extruded longitudinally away from the head end of the blank and thus the cavity is also being pushed longitudinally away from the head end of the blank as it is being transformed in shape by at least a portion of the displaced metal and the action of the extrusion surfaces of the die members. Thus, the extent of the longitudinal movement of the cavity is a function of the quantity of metal extruded during the thread rolling, tapering and pointing cycle. Since the quantity of metal extruded depends upon the diameter and type of point on the screw being produced, because of the variance in taper from one type of point to another, the preferred initial length of the cavity will vary with the size and type of fastener being made.

For example, approximately 100 pieces of American Standard, AB type, gimlet point, #8-18×1", sheet metal screws were produced from blanks having an initial shank length of 1.032 inch and having cavities contained therein of lengths of 0.100 inch, 0.070 inch and 0.050 inch. The finished screws made from those blanks having 0.100 inch and 0.070 inch cavities were observed to have nonuniform, ragged points while those made from blanks having cavities of 0.050 inch were observed to have smooth, uniform points.

The preferred length of the cavity extending longitudinally into the blank, therefore, is dependent upon the type and size of screw being produced and may be stated as approximately equal to the difference between the length of the shank of the blank from which the screw is to be made and the length of the shank of the finished screw.

The diameter of the cavity is preferably 0.5 times the diameter of the shank of the blank, but may vary between 0.6 and 0.4 times the shank diameter without having an adverse effect upon making a screw by a process of this invention.

What is claimed is:

1. A method for making a pointed, threaded screw, comprising providing a generally cylindrical screw blank having a hollow cavity extending longitudinally into the blank from one end thereof, roll threading, tapering and pointing at least a portion of said blank adjacent said cavity and breaking away a portion of said blank having said cavity therein.

2. A method for making a pointed threaded screw, comprising the sequential steps of:

(a) providing a screw blank having a cavity in one end of a shank portion, said cavity extending longitudinally inwardly from the outermost surface of said one end with axes of said cavity and said blank coincidental;

(b) rolling a continuous thread on at least a portion of said shank of said blank while tapering inwardly a threaded portion of said shank adjacent said cavity of said blank and longitudinally extruding a portion of said blank being displaced by said rolling and said tapering;

(c) shearing away said extruded portion and said end portion having said cavity therein; and (d) finishing and sizing said continuous thread on the shank of the tapered and pointed blank.

3. The method as described in claim 2 wherein said cavity is provided by drilling.

4. The method as described in claim 2 wherein said cavity is provided by extruding an end portion of said shank portion around a mandrel.

5. The method as described in claim 2 wherein the cavity in said screw blank is cylindrical in shape.

6. The method as described in claim 5 wherein the diameter of said cylindrical cavity is approximately one-half of the diameter of said shank portion and the length of said cylindrical cavity is equal to approximately the difference between the length of said shank of said blank and the length of the shank of a screw to be produced from said blank.

7. The method as described in claim 5 wherein the diameter of said cylindrical cavity is between 0.6 and 0.4 of the diameter of said shank portion and the length of said cylindrical cavity is equal to approximately the difference between the length of said shank of said blank and the length of the shank of a screw to be produced from said blank.

8. The method as described in claim 5 wherein said screw blank has an upset head on the end opposite said end having a cavity therein.

* * * * *